US008033683B2

(12) United States Patent
Fields

(10) Patent No.: US 8,033,683 B2
(45) Date of Patent: Oct. 11, 2011

(54) STAGGERED LED BASED HIGH-INTENSITY LIGHT

(75) Inventor: Craig Fields, Chicago, IL (US)

(73) Assignee: PerkinElmer LED Solutions, Inc., Wheeling, IL (US)

( * ) Notice: Subject to any disclaimer, the term of this patent is extended or adjusted under 35 U.S.C. 154(b) by 423 days.

(21) Appl. No.: 12/370,793

(22) Filed: Feb. 13, 2009

(65) Prior Publication Data

US 2009/0207605 A1 Aug. 20, 2009

Related U.S. Application Data

(60) Provisional application No. 61/065,845, filed on Feb. 15, 2008.

(51) Int. Cl.
*F21V 21/00* (2006.01)

(52) U.S. Cl. ..... 362/231; 362/249.02

(58) Field of Classification Search ..... 362/231, 362/230, 247, 249.02, 310
See application file for complete search history.

(56) References Cited

U.S. PATENT DOCUMENTS

| | | | | |
|---|---|---|---|---|
| 1,419,485 | A | 6/1922 | Arcaro et al. | 211/11 |
| 2,340,515 | A | 3/1941 | Dietrich | 240/41.35 |
| 4,929,866 | A | 5/1990 | Murata et al. | 313/500 |
| 4,964,025 | A | 10/1990 | Smith | 362/346 |
| 5,130,761 | A | 7/1992 | Tanaka | 357/17 |
| 5,136,483 | A | 8/1992 | Schoniger et al. | 362/61 |
| 5,471,371 | A | 11/1995 | Koppola et al. | 362/32 |
| 5,594,433 | A | 1/1997 | Terlep | 340/908.1 |
| 5,833,355 | A | 11/1998 | You et al. | 362/244 |
| 5,929,788 | A | 7/1999 | Vukosic | 340/908.1 |
| 6,183,100 | B1 * | 2/2001 | Suckow et al. | 362/35 |
| 6,364,506 | B1 | 4/2002 | Gallo | 362/245 |
| 6,464,373 | B1 * | 10/2002 | Petrick | 362/235 |
| 6,481,872 | B1 | 11/2002 | Hayashi et al. | 362/297 |
| 6,679,621 | B2 | 1/2004 | West et al. | 362/327 |
| 6,932,496 | B2 | 8/2005 | Rizkin et al. | 362/299 |
| 7,160,004 | B2 | 1/2007 | Peck | 362/341 |

(Continued)

FOREIGN PATENT DOCUMENTS

CA 2541686 4/2005

(Continued)

OTHER PUBLICATIONS

PCT International Search Report for International Application No. PCT/US2010/033123 dated Jul. 19, 2010 (4 pages).

(Continued)

*Primary Examiner* — David V Bruce
(74) *Attorney, Agent, or Firm* — Nixon Peabody LLP

(57) ABSTRACT

A high intensity LED based lighting array for use in an obstruction light with efficient uniform light output is disclosed. The high intensity LED based lighting array has a first concentric ring having a plurality of reflectors and light emitting diodes. The concentric ring has a planar surface mounting each of the plurality of reflectors in perpendicular relation to a respective one of the plurality of light emitting diodes. A second concentric ring is mounted on the first concentric ring. The second concentric ring has a second plurality of reflectors and light emitting diodes. The second concentric ring has a planar surface mounting each of the plurality of reflectors in perpendicular relation to a respective one of the plurality of light emitting diodes. The second plurality of reflectors and light emitting diodes are offset from the reflectors and light emitting diodes of the first concentric ring.

22 Claims, 5 Drawing Sheets

U.S. PATENT DOCUMENTS

| | | | | |
|---|---|---|---|---|
| 2002/0085374 | A1 | 7/2002 | Anderson | 362/147 |
| 2005/0110649 | A1* | 5/2005 | Fredericks et al. | 340/815.45 |
| 2006/0007012 | A1 | 1/2006 | Machi et al. | 340/815.45 |
| 2006/0198141 | A1* | 9/2006 | Peck et al. | 362/247 |
| 2006/0291209 | A1 | 12/2006 | Booth et al. | 362/247 |
| 2007/0081331 | A1 | 4/2007 | Wang | |
| 2010/0027281 | A1* | 2/2010 | Waters et al. | 362/470 |

FOREIGN PATENT DOCUMENTS

| | | |
|---|---|---|
| EP | 1698823 | 6/2006 |
| EP | 1731423 | 6/2006 |
| EP | 2090820 | 2/2009 |
| GB | 2350176 | 5/1999 |
| WO | WO 9519525 | 7/1995 |
| WO | WO 0249917 | 6/2002 |
| WO | WO 2004070266 | 8/2004 |

OTHER PUBLICATIONS

PCT Written Opinion for International Application No. PCT/US2010/033123 dated Jul. 19, 2010 (8 pages).

European Search Report for International Application No. 09152762.2 dated Jul. 14, 2010 (8 pages).

* cited by examiner

STAGGERED LED BASED HIGH-INTENSITY LIGHT

RELATED APPLICATIONS

This application claims priority to U.S. Provisional Application No. 61/065,845 filed on Feb. 15, 2008 which is hereby incorporated by reference in its entirety.

FIELD OF THE INVENTION

The present invention relates to high intensity lights, and more specifically to an LED-based high intensity obstruction light.

BACKGROUND OF THE INVENTION

High intensity lights are needed for beacons for navigation. For example, navigation lamps must be capable of meeting the 20,000 cd requirements for the FAA (US Federal Aviation Authority) L865-L864 standard and the ICAO (International Civil Aviation Organization) Medium Intensity Navigation Lights. In the past, lamps have used conventional strobe lights. However, such lights are energy and maintenance intensive. Recently, due to certain regulatory changes, lamps have been fabricated using light emitting diodes (LEDs). LEDs create unique requirements in order to be commercially viable in terms of size, weight, price, and cost of ownership compared to conventional strobe lights.

The FAA and ICAO regulations set the following stringent requirements for beam characteristics at all angles of rotation (azimuth). Lights must have effective (time-averaged) intensity greater than 7500 candela (cd) over a 3° range of tilt (elevation). Lights must also have peak effective intensity of 15,000-25,000 cd and effective intensity window at −1° elevation of "50% min and 75% max" for the ICAO only. The ICAO standard sets this "window" of beam characteristics at −1° of elevation and must be met at all angles of rotation (azimuth).

Light devices must also meet the requirements of the FAA compliant version producing 60,000 cd peak intensity in 100 msec flashes. Such lights must also meet the requirements of the ICAO compliant version producing 25,333 cd peak intensity in 750 msec flashes. Ideally, lights also are configurable to provide 2,000 cd red light in addition to the 20,000 cd white light for day and night time operation.

In order to achieve the total light intensity required for an FAA or ICAO compliant light using LEDs, it is necessary to use a large number of LED light sources. However, it is difficult to create a beam with the desired intensity pattern when directing large numbers of LED sources into few reflectors. Furthermore, smaller and therefore more numerous reflectors are needed to conform to overall size restrictions. These constraints all result in a design with a large number of optical elements comprised of individual LEDs and small reflectors. A final challenge is alignment of the multiple optical elements such that their outputs combine to form a beam that is uniform at all angles of azimuth.

Currently, available LED lamps simply stack multiple optical elements symmetrically with no offset, as well as use large reflectors and multiple LEDs per reflector. While compliant, such lamps require a more than optimal number of LEDs and thus are more complex and expensive.

Thus an efficient LED-based lamp that meets FAA and ICAO standards currently does not exist. An LED lamp that allows the use of relatively smaller reflectors is desirable to meet such standards. An LED lamp design that reliably provides uniform light output in compliance with such standards also does not exist.

SUMMARY

One disclosed example relates to a high intensity LED-based light with a first concentric ring having a plurality of reflectors and light emitting diodes. The concentric ring has a planar surface mounting each of the plurality of reflectors in perpendicular relation to a respective one of the plurality of light emitting diodes. A second concentric ring is mounted on the first concentric ring. The second concentric ring has a second plurality of reflectors and light emitting diodes. The second concentric ring has a planar surface mounting each of the plurality of reflectors in perpendicular relation to a respective one of the plurality of light emitting diodes. The second plurality of reflectors and light emitting diodes are offset from the reflectors and light emitting diodes of the first concentric ring.

Additional aspects will be apparent to those of ordinary skill in the art in view of the detailed description of various embodiments, which is made with reference to the drawings, a brief description of which is provided below.

Figure 1:
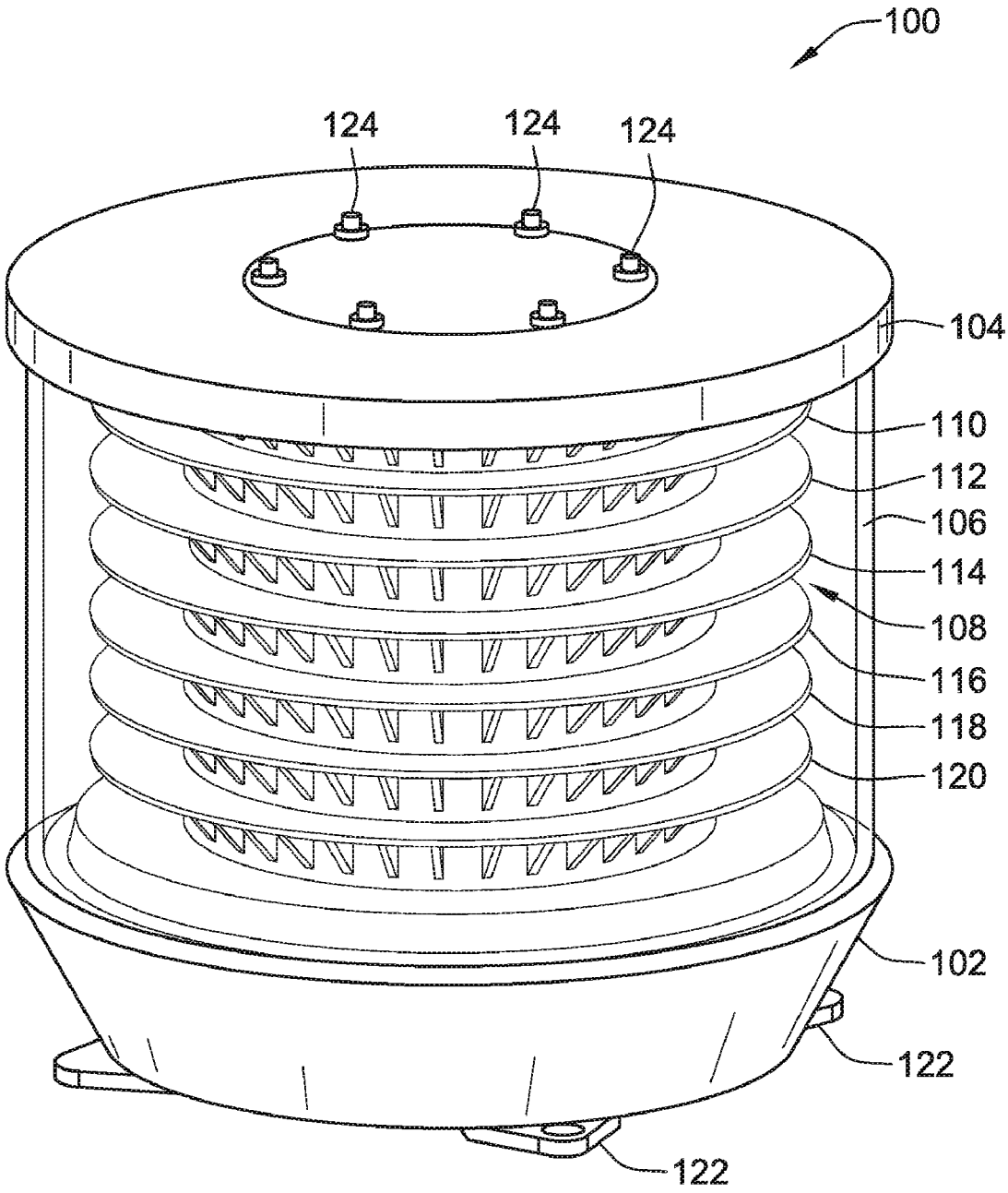
FIG. 1 is a perspective diagram of an example staggered LED high intensity light.

While these examples are susceptible of embodiment in many different forms, there is shown in the drawings and will herein be described in detail preferred examples with the understanding that the present disclosure is to be considered as an exemplification and is not intended to limit the broad aspect to the embodiments illustrated.

DETAILED DESCRIPTION

FIG. 1 shows an example high intensity LED-based lamp 100. The LED-based lamp may be used as an aircraft beacon obstruction light and may be compliant with applicable FAA and ICAO standards. The high intensity LED-based lamp 100 has a base 102, a top housing 104, and a transparent cylindrical housing 106. The base 102, top housing 104, and transparent cylindrical housing 106 enclose a lighting array 108. The base 102 and top housing 104 provide support and alignment for the lighting array 108 while allowing heat to be transferred from the LEDs and power supplies in the lighting array 108 to the ambient surroundings.

The lighting array 108 has a series of concentric lighting rings 110, 112, 114, 116, 118, and 120 that will be detailed below. As shown in FIG. 1, the concentric lighting rings 110, 112, 114, 116, 118, and 120 are arrayed in a vertical stack with the concentric lighting ring 110 at the top of the stack and the concentric ring 120 at the bottom of the stack.

The cylindrical housing 106 is a generally cylindrical transparent housing that protects the optical elements on the concentric lighting rings 110, 112, 114, 116, 118, and 120 while allowing the transmission of light generated by the optical elements on the concentric lighting rings 110, 112, 114, 116, 118, and 120.

The base 102 is generally cylindrical in shape and contains wiring, power supplies, and controls for the optical elements of the concentric lighting rings 110, 112, 114, 116, 118, and 120. The base 102 has a plurality of mounting points 122 that allow the light 100 to be mounted on a flat surface. The top housing 104 includes a number of bolts 124 that are attached to rods (not shown) extending throughout the concentric lighting rings 110, 112, 114, 116, 118, and 120. The bolts 124 cap the rods and hold the rods to attach the top housing 104 to the base 102. The rods align the rings 110, 112, 114, 116, 118, and 120 in place as will be explained below.

Figure 2:
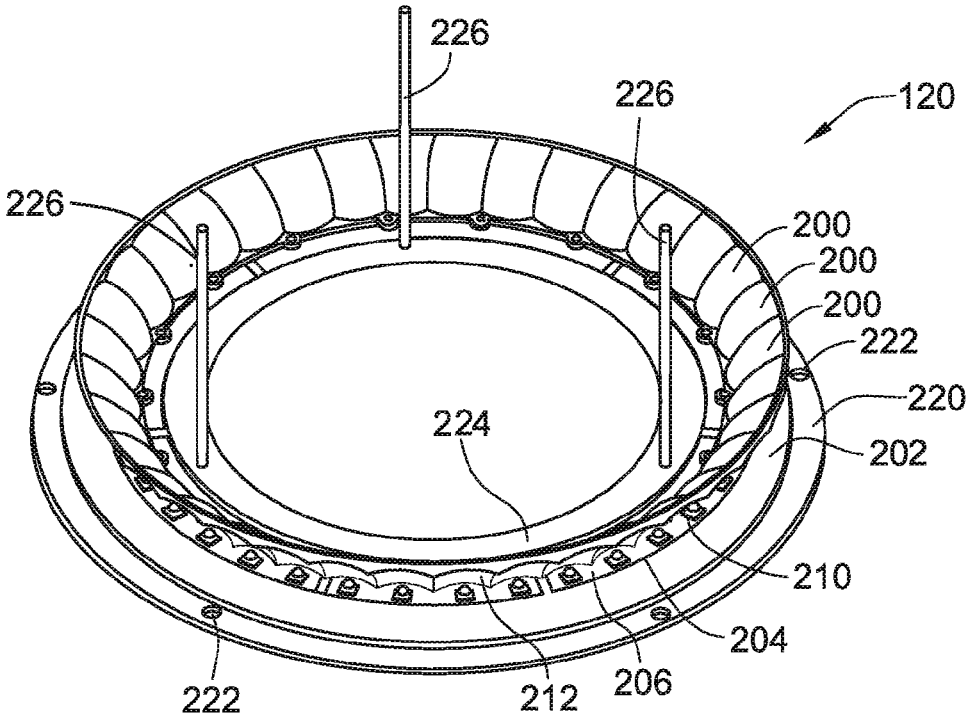
FIG. 2 is a perspective view of the bottom concentric ring of LEDs and reflectors of the intensity light in FIG. 1.

FIG. 2 is a perspective view of the bottom concentric lighting ring 120 of FIG. 1. The concentric lighting ring 120 has multiple optical elements 200 that emit light from the entire circumference of the concentric lighting ring 120. The concentric lighting ring 120 supports and aligns the optical elements 200 around the entire circumference of the concentric lighting ring 120 as shown in FIG. 2. The concentric lighting ring 120 has a circular base member 202 with a ring shaped top surface 204. In this example, six of the optical elements 200 are mounted on an arc-shaped supporting circuit board 206. In this example, there are 36 total optical elements 200 in the concentric lighting ring 120 mounted on six supporting circuit boards 206. The 36 optical elements 200 arrayed around the concentric lighting ring 120 are arranged so that each optical element 200 (LED 210 and reflector 212) occupies 10° of the circumference of the concentric lighting ring 120. Of course it is to be understood that different numbers of optical elements and circuit boards may be used. Each of the optical elements 200 has an LED 210 and a reflector 212. The supporting circuit board 206 serves to support and align the LEDs 210 and the reflectors 212. The circuit board 206 transfers heat from the LEDs 210 to the base member 202 and direct electrical power to the LEDs 210 via power supplies in the base 102 in FIG. 1. In this example, the supporting circuit board 206 is a thermally conductive printed circuit board (PCB), having a metal core of aluminum or copper. The LEDs 210 are preferably attached using solder, eutectic bonding, or thermally conductive adhesive. The supporting circuit board 206 has physical registration features such as holes or slots that allow the reflectors 212 to be aligned or centered optically with each of the LEDs 210.

The base member 202 includes an outer mounting ring 220 that includes a number of holes 222. The holes 222 allow the fixing of the concentric lighting ring 120 to the base 102 in FIG. 1 via bolts (not shown). The base member 202 also includes an inner mounting ring 224. The inner mounting ring 224 has a number of alignment rods 226 that extend upwards from the concentric lighting ring 120 to align the further concentric lighting rings 110, 112, 114, 116, and 118 in FIG. 1.

Figure 3:
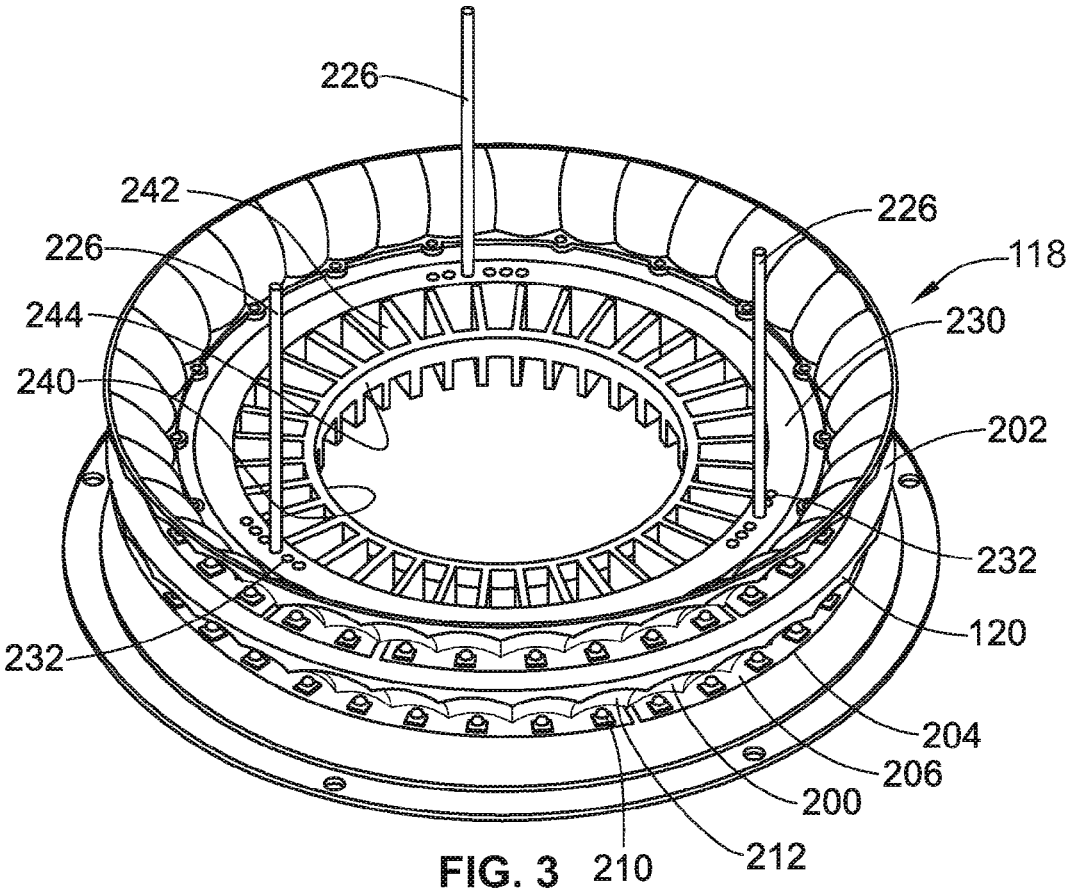
FIG. 3 is a perspective view of two of the concentric rings of LEDs and reflectors of the intensity light of FIG. 1.

FIG. 3 shows a perspective view of the concentric rings 120 and 118 assembled with each other. In FIG. 3, identical elements in the concentric ring 118 to those in the concentric ring 120 are given the same element numbers. Similar to the bottom concentric ring 120, the concentric lighting ring 118 has a circular base member 202 with a ring-shaped top surface 204 supporting six supporting circuit boards 206. The circuit boards 206 mount 36 total optical elements 200 so that each optical element 200 (LED 210 and reflector 212) occupies 10° of the circumference of the concentric lighting ring 118.

The concentric lighting ring 118 has an inner mounting ring 230. The inner mounting ring 230 has a series of alignment holes 232 that are staggered approximately 1.6667 radial degrees from each other. In this example, there are six alignment holes 232 in each group of holes, but it is to be understood that different numbers of alignment holes may be used and such holes may be spaced at different angles from each other. The alignment rods 226 are inserted through corresponding holes 232 in each of the three groups to offset the concentric lighting ring 118 from the bottom concentric lighting ring 120 by 1.6667 radial degrees. This results in each of the optical elements 200 in the bottom concentric lighting ring 120 to be offset from each of the optical elements 200 in the next concentric lighting ring 118 by 1.6667 radial degrees. The other concentric lighting rings 110, 112, 114, and 116 are identical to the concentric lighting ring 118 and are similarly offset from each other.

The concentric lighting ring 118 also has a heat sink 240 that is thermally coupled to the inner mounting ring 230. The heat sink 240 has a number of radially extending vanes 242 that are mounted between the inner mounting ring 230 and a central ring 244. The supporting circuit boards 206 have physical registration features, such as a tab or a slot that fix its radial position on the base member 202 and the heat sink 240. The heat sink 240 allows heat from the circuit boards 206 to be dissipated.

Figure 4:
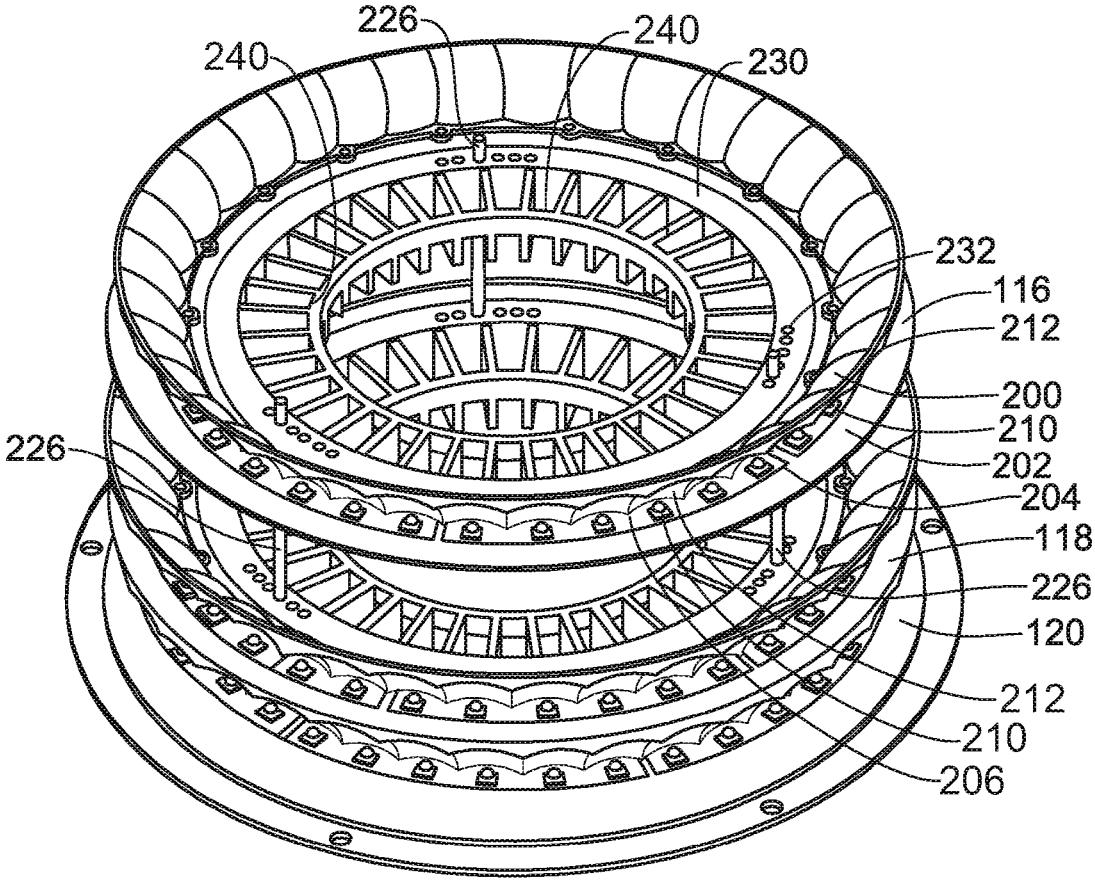
FIG. 4 is a perspective view of the addition of a third concentric ring of LEDs and reflectors to the two concentric rings of the intensity light of FIG. 1.

FIG. 4 is a perspective view of the assembly of the bottom concentric lighting ring 120 and the concentric lighting ring 118. FIG. 4 shows the concentric lighting ring 116 before assembly to the concentric lighting rings 118 and 120. In FIG. 4, identical elements in the concentric ring 116 to those in the concentric rings 118 and 120 are given the same element numbers. Similar to the concentric ring 118, the concentric lighting ring 116 has a circular base member 202 with a ring-shaped top surface 204 supporting six supporting circuit boards 206. The circuit boards 206 mount 36 total optical elements 200 so that each optical element 200 (LED 210 and reflector 212) occupies 10° of the circumference of the concentric lighting ring 116.

As shown in FIG. 4, the concentric ring 116 is aligned to be offset from the concentric ring 118 by using different alignment holes 232 in conjunction with the alignment rods 226. The concentric ring 116 is aligned in the proper offset and is dropped on the concentric ring 118 using the alignment rods 226 as guides. The use of the alignment rods 226 prevent tolerance stacking and allow proper alignment of the offsets between the concentric rings 110, 112, 114, 116, 118, and 120.

Heat is removed from the LEDs 210 in the optical elements 200 in the concentric rings 110, 112, 114, 116, 118, and 120 via conduction through the circuit boards 206, through conductive grease or adhesive to the heat sink 240. Each heat sink 240 has a sufficient mating surface to the heat sinks 240 in the above or below concentric lighting ring and also can use thermal grease to reduce thermal contact resistance. Heat is conducted through the rings 110, 112, 114, 116, 118, and 120 to a lower plate attaching the concentric lighting rings to the base 102. Heat in the bottom concentric ring 120 is transferred to the base 102 and may then be conducted to the mounting surface, or transferred by convection to the ambient air. Heat may also be removed by a conductive or convective path to the top housing 104. Heat may also be removed convectively from the heat sinks 240 by adding fins on the rings and using a circulating fan. Radiative heat losses can be enhanced by applying surface treatments such as paint to the top housing 104, bottom plate, and base 102.

Figure 5:
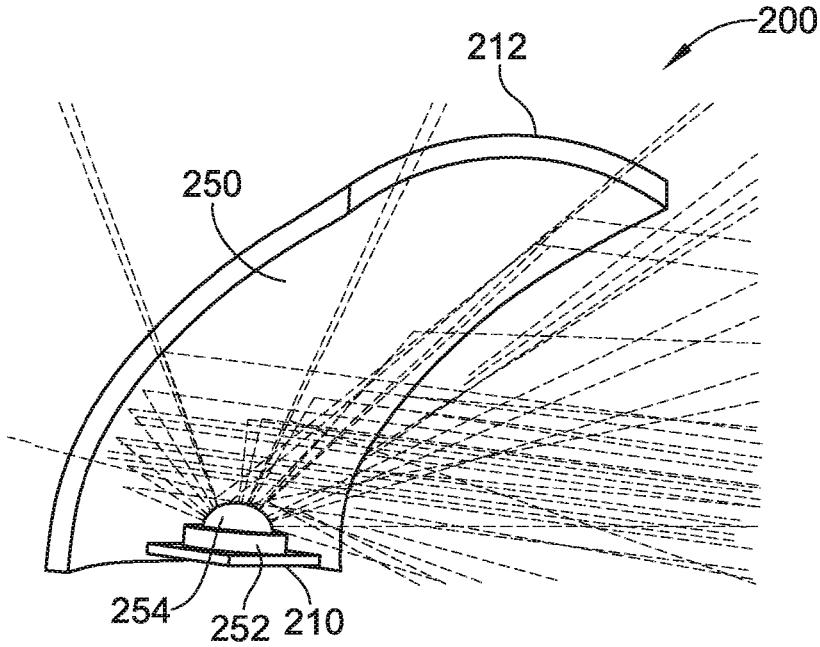
FIG. 5 is a perspective view of and ray trace from an optical element having a single LED and reflector mounted on one of the concentric rings of the intensity light of FIG. 1.

FIG. 5 is a close up perspective view of the optical element 200 that is installed on each of the concentric rings 110, 112, 114, 116, 118, and 120 in FIG. 1. Each of the optical elements such as the optical element 200 includes the LED 210 and the reflector 212. The LED 210 is vertically oriented in relation to the reflector 212. In this example, the LED 210 is a high-brightness white LED such as an XLamp XREWHT 7090 XR series LED available from Cree. Alternatively different color LEDs such as a red LED may be used. The reflector 212 has an optical surface 250. The optical surface 250 of the reflector 212 may have multiple curved surfaces. Alternatively, the optical surface 250 may have one or more parabolic surfaces, though other surface geometries such as elliptical or hyperbolic may be used, as well as various combinations of such curved surfaces such as conic, aspheric, anamorphic, or faceted may be used. The reflector 212 is designed to form a horizontal (azimuth) beam approximately 50 to 100 wide at its half-maximum intensity. The reflector 212 is constructed of plastic in this example and molded in clusters of six reflector elements per cluster. The reflector 212 is coated with aluminum or other highly reflective material.

The LED 210 includes an enclosure unit 252 that includes a lens 254. By using a power LED package that includes the lens 254 providing a moderate degree of collimation, the size of the required reflector 212 can be minimized, allowing the practical use of one individual reflector 212 per LED 210. Of course, using a non-collimated or near-lambertian LED may be used, but would either lead to generally larger reflector surfaces to capture sufficient light or have a lower efficiency.

The vertical orientation of the LED 210 causes the majority of the light from the LED 210 to hit a reflecting surface such as the optical surface 250 of the reflector 212 before exiting the optical element 200. This ensures that the majority of the light has been controlled by a designed surface as shown by the rays in FIG. 5. The vertical orientation also allows use of a smaller reflector for optical beam shaping. The optical surfaces of each individual reflector 212 are optimized for a single LED 210. The reflector surfaces are designed to form the vertical (elevation) collimation required and to form the desired horizontal (azimuth) beam.

As shown in FIGS. 3 and 4, each of the concentric lighting rings 110, 112, 114, 116, 118, and 120 are rotationally offset from each other resulting in the respective optical elements 200 to be staggered from each other. The offset position of the concentric rings results in their respective optical elements 200 to have combined beam patterns of light intensity in relation to elevation closely matched at all angles of azimuth so that the combined beams will lie within the allowable "windows" of the ICAO and FAA requirements for the example light 100 in FIG. 1. A plot of intensity versus azimuth angle at a fixed angle of elevation for the combined optical elements 200 will show minimal variation, or "ripple." "Ripple" is herein defined as the peak-to-peak variation in intensity relative to the average intensity at all angles of azimuth. Sources of ripple along the azimuth can be attributed to two categories: superposition errors and LED errors. Superposition errors include: mechanical errors and misalignments in construction, optical tolerances, and optical surface design deficiencies. LED errors include: flux or intensity variations, and beam shape variations, both are LED to LED issues. Also included in LED errors is LED model error, which is the difference between optical beam properties of real LED's and the optical model of the LED's used during optical design. Radial stagger between rings minimizes the ripple from both of the sources of ripple. Minimum ripple allows the high intensity light 100 to feasibly meet the FAA and ICAO requirements. Further, the drive current and/or the number of LEDs necessary to achieve minimum intensity at all points is reduced.

Figure 6:
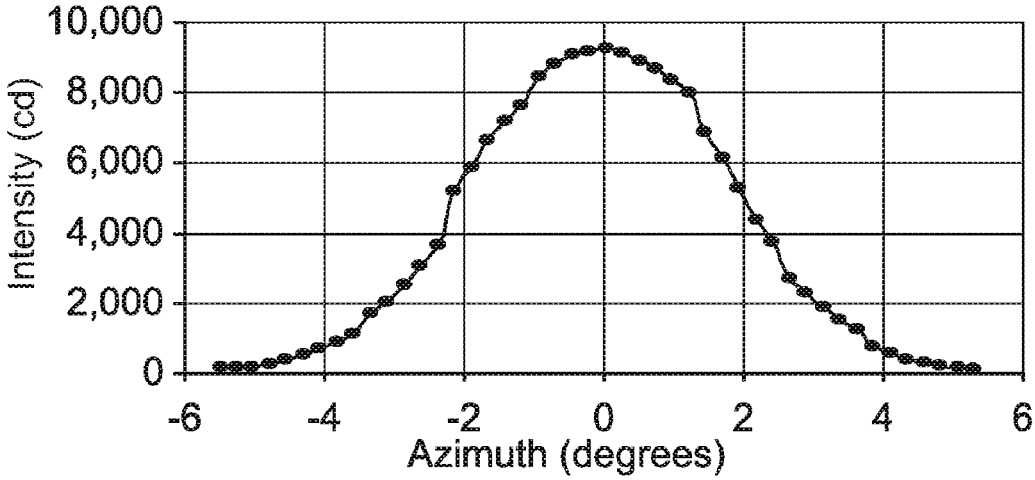
FIG. 6 is a graph of the measured light output from an optical element of FIG. 5.

FIG. 6 shows the measured light from a single typical LED-reflector optical element such as the optical element 200 in FIGS. 2-3. FIG. 6 is a graph showing intensity versus azimuth angle at a fixed elevation angle. As explained above, a single row of the elements 200 are at radial intervals of 10 within the circumference of a concentric ring such as the concentric ring 120 shown in FIG. 2. A second ring of the optical elements 200 such as the concentric ring 118 fills in the "gaps" (regions of low light intensity) from the first ring 120 as shown in FIGS. 2-3. To then achieve the desired total light output, a minimum of three of these ring pairs is required.

Figure 7:
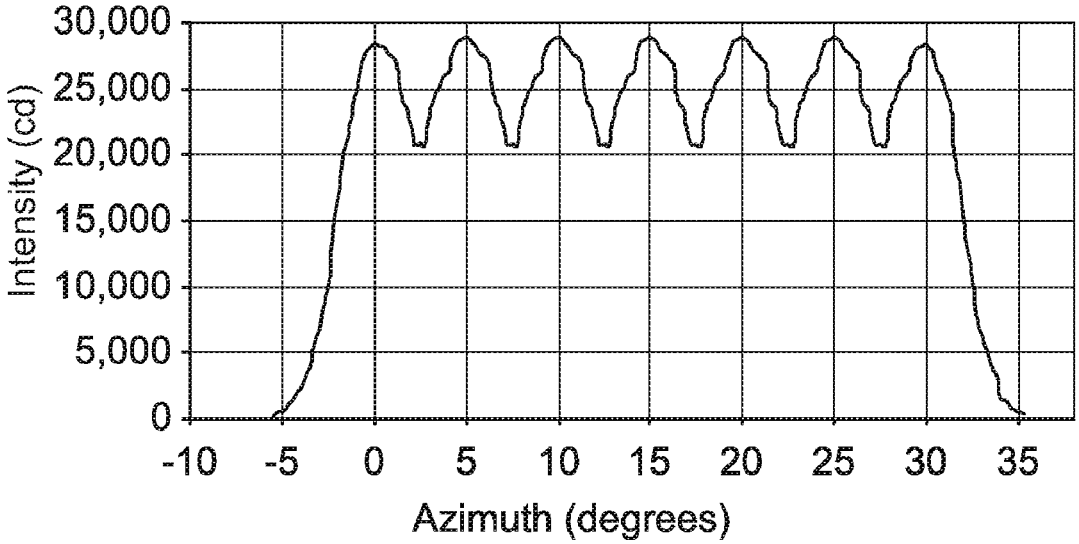
FIG. 7 is a graph showing the beam pattern from one group of the optical elements of staggered concentric rings using an offset angle of 5 degrees.

FIG. 7 is a graph showing the beam pattern from one group of the optical elements of two staggered concentric rings using an offset angle between rings of 5 degrees. As the graph in FIG. 7 shows, there is less variation ("ripple") in intensity as a function of azimuth angle, but the gaps in one row's output is not fully filled by the offset row. This is because the 50% azimuth intensity amplitude points and slopes of the individual optical elements are not ideal, and the ripple is still a significant percentage of the average azimuth value.

Figure 8:
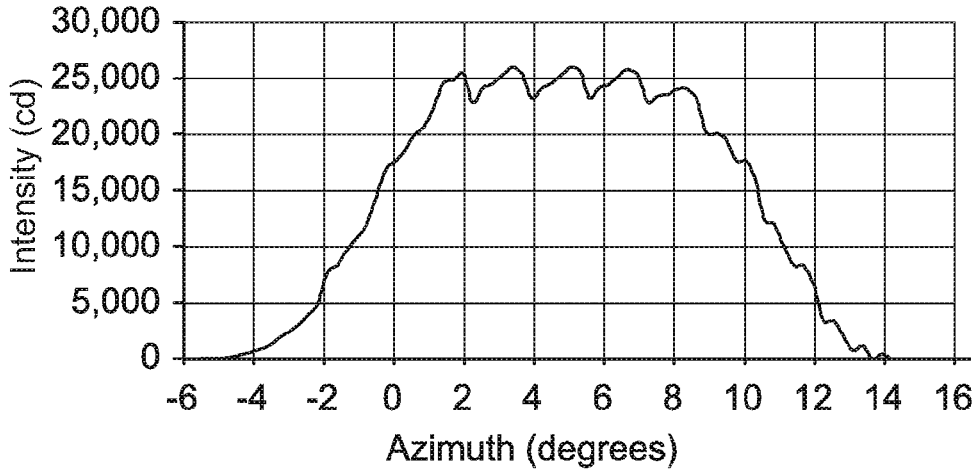
FIG. 8 is a graph showing the beam pattern from one group of the optical elements of the staggered concentric rings of the intensity light of FIG. 1.

FIG. 8 is a graph showing the beam pattern from one group of the optical elements of six staggered concentric rings of the intensity light 100 of FIG. 1. The offset ("stagger") has been optimized for the six concentric rings 110, 112, 114, 116, 118, and 120 of optical elements 200 to 1.667 per ring (10 per element divided by six rings). The calculated variation in output ("ripple") is now greatly reduced. This further reduces any residual ripple in the reflector-LED design by not having ripple repeated or reinforced three times, once by each layer. Other offsets can be calculated using different numbers of rows or optical elements per row using this method. The radial offset between concentric rings is roughly equal to 360 degrees divided by the number of optical elements per ring and the number of rings of a given color. A reflector design that has a 50% azimuth beam width of 10 could also be envisioned that would allow for a complete filling of the azimuth in one layer instead of two as mentioned above. This also allows layers to be staggered to minimize ripple, and could allow some flexibility for differing intensity requirements. Reflector designs could also be further optimized so that the summation of intensities, as illustrated in FIGS. 7-8, has even less ripple variation.

A number of variations may be made on the example high intensity light 100 in FIG. 1. The light 100 could be modified with an additional concentric ring of red LEDs. With an additional concentric ring of red LEDs, the light could be used in either daytime (using the optical elements in the six concentric rings) or nighttime using the concentric ring of red LEDs.

Figure 9:
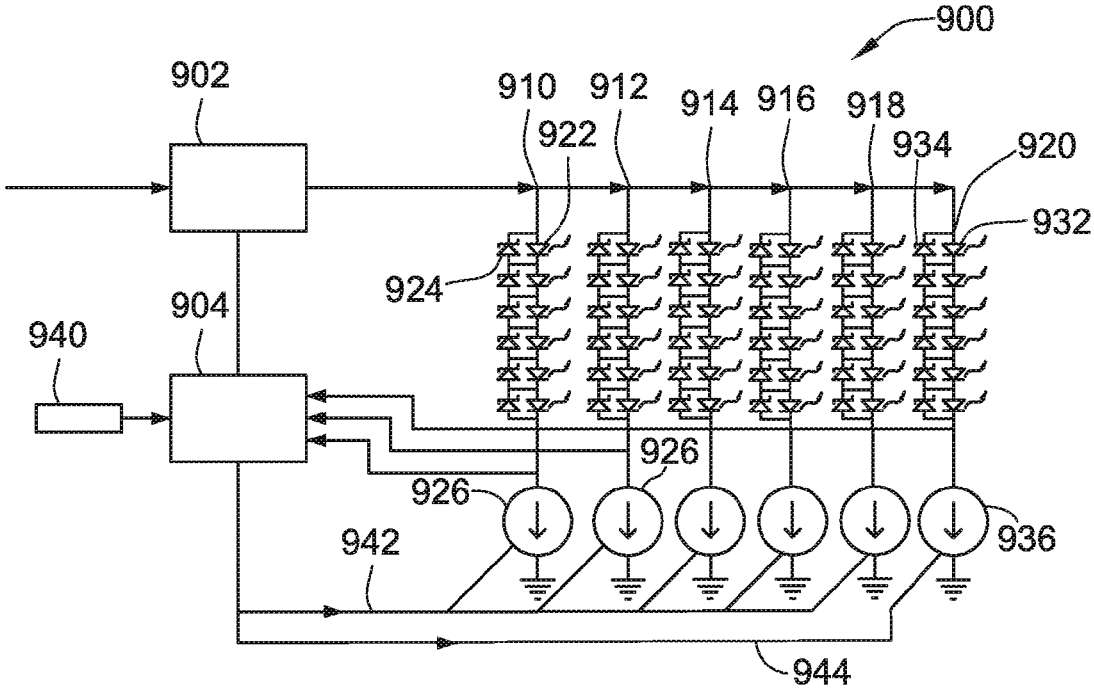
FIG. 9 is a circuit diagram of an electronic system for a second example of a high intensity light.

An example of such a variation is shown in FIG. 9. FIG. 9 is a block diagram of an electric control system 900 for a high intensity LED-based light that has both daytime and nighttime capabilities in accordance with FAA and ICAO requirements. The electric control system 900 includes a power supply 902 and a timing and control module 904. The power supply 902 supplies power to six circuit boards 910, 912, 914, 916, 918, and 920 that are similar to circuit boards 206 on the concentric rings 110, 112, 114, 116, 118, and 120 in the light 100 in FIG. 1. Each of the six circuit boards 910, 912, 914, 916, and 920 have six high intensity white LEDs 922 that are wired in parallel with a zener diode 924 to bypass current on the respective white LEDs 922 in the event of an open failure. Each of the circuit boards 910, 912, 914, 916, 918, and 920 are coupled to a constant current source 926. Of course other wiring schemes such as parallel wiring of the LEDs may be made.

The electric control system 900 also includes another circuit board 930 that has a series of high intensity red LEDs 932. The red LEDs 932 are each coupled in parallel with a zener diode 934 to bypass current on the respective red LEDs 932 in the event of an open failure. The circuit board 930 is coupled to a constant current source 936.

The electric control system 900 is appropriate for an obstruction lamp that may be employed during both daylight and nighttime. Daytime use requires brighter light in the form of at least the optical elements emitting white light of six concentric rings similar to the concentric rings 110, 112, 114, 116, 118, and 120 in the light 100 in FIG. 1. Nighttime use requires at least a single concentric ring of red LEDs having multiple circuit boards such as the circuit board 930 in FIG. 9. A daylight sensor 940 is coupled to the timing and control module 904. The daylight sensor 940 may be mounted on an exterior surface of the light, for example on the top housing 104 of the light 100 in FIG. 1. The signals received from the daylight sensor 940 enable the timing and control module 904 to activate either a daytime or nighttime mode. In the daytime mode, control pulses are sent to the current sources 926 to pulse the white LEDs 922 on and off via a control line 942. In the nighttime mode, control pulses are sent to the current source 936 to pulse the red LEDs 932 on and off via a control line 944. In addition, lines may be coupled from the strings of LEDs 922 and 934 to the timing and control module 904 to sense the voltage across the LEDs 922 and 934 to detect open failures. The timing and control module 904 may be programmed to alert an operator of such a failure.

The optical elements 200 could also be modified with other reflector geometry. Further, side-firing LEDs directed back into a reflector could be used for the optical elements 200. The reflectors could also be reflectors combined in groups. Also, multiple LEDs may be used for each reflector. Staggered TIR optics could be used for the reflectors. Different numbers of LEDs per ring and different number of rings may also be used. An equivalent linear light with similar staggered sources could be used. An electrical control system with adjustable current for each LED or group of LEDs could be used to further reduce variations in beam intensity and uniformity.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A lighting array for a high intensity light comprising:

a first ring having a first plurality of reflectors having a reflective surface and light emitting diodes disposed on the circumference of the first ring, the ring having a planar surface mounting each of the plurality of reflectors such that the reflective surface is in substantially perpendicular relation to a respective one of the plurality of light emitting diodes; and a second ring mounted on the first ring, the second ring having a second plurality of reflectors and light emitting diodes disposed on the circumference of the second ring, the second ring having a planar surface mounting each of the plurality of reflectors in perpendicular relation to a respective one of the plurality of light emitting diodes, wherein the number of light emitting diodes in the first ring is the same as the number of light emitting diodes in the second ring and each of the second plurality of reflectors and the first and second rings are rotationally offset such that the light emitting diodes and respective reflectors of the second ring are staggered by a radial angle from the respective reflectors and light emitting diodes of the first ring.

2. The lighting array of claim 1, further comprising a third, fourth, fifth and sixth ring, each ring having a plurality of reflectors and light emitting diodes, the third, fourth, fifth and sixth rings mounted on the second ring.

3. The lighting array of claim 2, further comprising a seventh ring having a plurality of reflectors and red light emitting diodes, and wherein the light emitting diodes of the first through sixth rings are white light emitting diodes.

4. The lighting array of claim 1, wherein the high intensity light is compliance with FAA and ICAO standards.

5. The lighting array of claim 1, wherein the first ring includes a plurality of circuit boards mounting the light emitting diodes and a heat sink coupled to the plurality of circuit boards.

6. The lighting array of claim 1 further comprising:

a base member;

a rod extending from the base member; and wherein the first and second rings include an alignment hole for mounting the rod, the alignment holes for the first and second rings being radially offset to fix the first and second rings in position with each other via mounting the rod.

7. The lighting array of claim 1, wherein the reflectors include one or more parabolic, conic, aspheric, anamorphic, or faceted reflector surfaces.

8. The lighting array of claim 1, wherein the reflectors each form a horizontal beam approximately 5° wide.

9. The lighting array of claim 1, where the radial angle between rings is roughly equal to 360 degrees divided by the number of LEDs on a ring and the rings of a given LED color.

10. The lighting array of claim 1, where a radial angle offset between the LEDs of the rings is used to reduce azmuith ripple.

11. The lighting array of claim 1, where the plurality of reflectors consists of TIR or other optical elements.

12. A lighting array for a high intensity light beacon compliant with FAA or ICAO standards, the lighting array comprising:

a base member;

a first ring mounted on the base member, the first ring having a plurality of reflectors each having a reflective surface and corresponding light emitting diodes disposed on the circumference of the first ring sufficient for 360 degree light emission from the first ring, the first ring having a planar surface mounting each of the plurality of reflectors in perpendicular relation to a respective one of the plurality of light emitting diodes; and a second ring mounted on the first ring, the second ring having a second plurality of reflectors each having reflective surface and light emitting diodes disposed on the circumference of the second ring sufficient for 360 degree light emission from the second ring, the second ring having a planar surface mounting each of the plurality of reflectors in perpendicular relation to a respective one of the plurality of light emitting diodes, wherein the number of light emitting diodes in the first ring is the same as the number of light emitting diodes in the second ring and each of the second plurality of reflectors and the first and second rings are rotationally offset such that the light emitting diodes and respective reflectors of the second ring are staggered by a radial angle from the respective reflectors and light emitting diodes of the first ring.

13. The lighting array of claim 12, further comprising a third, fourth, fifth and sixth ring, each ring having a plurality of reflectors and light emitting diodes, the third, fourth, fifth and sixth rings mounted on the second ring.

14. The lighting array of claim 13, further comprising a seventh ring having a plurality of reflectors and red light emitting diodes, and wherein the light emitting diodes of the first through sixth rings are white light emitting diodes.

15. The lighting array of claim 12, wherein the first plurality of light emitting diodes is 36 light emitting diodes and the second plurality of light emitting diodes is 36 light emitting diodes.

16. The lighting array of claim 12, wherein the first ring includes a plurality of circuit boards mounting the light emitting diodes and a heat sink coupled to the plurality of circuit boards; and wherein the second ring includes a second plurality of circuit boards mounting the second plurality of light emitting diodes and a second heat sink coupled to the second plurality of light emitting diodes.

17. The lighting array of claim 12 further comprising a rod extending from the base member; and wherein the first and second rings include an alignment hole for mounting the rod, the alignment holes for the first and second rings being offset to fix the first and second concentric rings in position with each other via mounting the rod.

18. The lighting array of claim 12, wherein the reflectors include one or more parabolic, conic, aspheric, anamorphic, or faceted reflector surfaces.

19. The lighting array of claim 12, wherein the reflectors each form a horizontal beam approximately 5° wide.

20. The lighting array of claim 12, where the radial offset between the LEDs of the rings is roughly equal to 360 degrees divided by the number of LEDs on a ring and the number of rings of a given color.

21. The lighting array of claim 12, where a radial offset between rings is used to reduce azimuth ripple.

22. The lighting array of claim 12, where the plurality of reflectors consists of TIR or other optical elements.

* * * * *